US005328221A

United States Patent [19]

Richardson, Jr.

[11] Patent Number: 5,328,221

[45] Date of Patent: Jul. 12, 1994

[54] CORE PULLER FOR PULLING TEST CORES

[75] Inventor: Thomas D. Richardson, Jr., Cleveland, Ohio

[73] Assignee: G. R. Osterland Company, Cleveland, Ohio

[21] Appl. No.: 906,361

[22] Filed: Jun. 30, 1992

[51] Int. Cl.[5] ..... A01B 1/00

[52] U.S. Cl. ..... 294/50.7; 73/864.44; 294/119.2

[58] Field of Search ..... 294/15, 16, 28, 31.2, 294/33, 50, 50.5, 50.7, 90, 91, 119.2; 37/2 R; 73/864.44, 864.45, 864.51; 111/92, 100, 101, 106; 172/21, 22

[56] References Cited

U.S. PATENT DOCUMENTS

| | | | |
|---|---|---|---|
| 42,391 | 4/1864 | Milo | 294/50.7 X |
| 273,181 | 2/1883 | Spitznass | 294/50.7 X |
| 1,021,984 | 4/1912 | Holmes | 294/90 |
| 1,038,924 | 9/1912 | Matthews | 294/50.7 X |
| 1,451,199 | 4/1923 | Blair | 294/90 |
| 1,553,665 | 9/1925 | Bergsten | 294/90 |
| 1,618,568 | 2/1927 | Carlson | 294/16 |
| 1,847,136 | 3/1932 | Rauberstrauch | 73/864.44 X |
| 2,294,542 | 9/1942 | Chulick et al. | 294/28 X |
| 2,593,924 | 4/1952 | Rothkamm | 294/50.7 X |
| 2,831,720 | 4/1958 | Renfroe | 294/31.2 |
| 2,863,258 | 12/1958 | Gish | 294/50.7 X |
| 2,989,335 | 6/1961 | North | 294/50.7 X |
| 2,994,551 | 8/1961 | Garnett | 294/15 |
| 2,999,714 | 9/1961 | Ritchie | 294/31.2 |
| 3,284,932 | 11/1966 | Wendlandt | 294/50.7 X |
| 3,461,192 | 8/1969 | Di Stasio | 73/864.44 X |
| 3,471,192 | 10/1969 | Childs et al. | 294/50.7 |
| 3,817,435 | 6/1974 | De Luca et al. | 294/31.2 X |
| 4,834,441 | 5/1989 | Schivley | 294/90 |
| 5,004,282 | 4/1991 | Perry | 294/16 |

*Primary Examiner*—Johnny D. Cherry
*Attorney, Agent, or Firm*—Foley & Lardner

[57] ABSTRACT

An apparatus and method for removing cores from a material to be tested includes a first split shell having a first split portion, a tightening device for moving confronting ends of the first shell towards each other so that the shell grips the core to be pulled, and a handle for pulling the core. The core puller is inserted into a space left by a drill bit. The core puller is tightened around the core to be pulled, and the core is then pulled.

7 Claims, 3 Drawing Sheets

CORE PULLER FOR PULLING TEST CORES

BACKGROUND OF THE INVENTION

The present invention relates in general to an apparatus and method for obtaining test cores, and in particular to an apparatus and method for obtaining test cores from concrete and asphalt pavement.

In the paving industry, highway and street authorities and engineers, as well as private engineers on parking lots, require that paving contractors drill out sample cores of pavement after it has been sufficiently cured. These cores are subjected to standard tests to verify the composition and hardness of the pavement. This method is used for both asphalt and concrete paving. The core samples are generally obtained by using a vertical core drill which drills out a core of the material using a tubular diamond-tipped bit driven by a gas or electric drill. The cores generally vary from 4–12 inches in length and are of varying diameters (depending on the preference of the testers).

To test the cores and obtain results that are representative of the pavement in general, it is important to keep the cores intact. Several methods presently used to extract sample cores are: 1) drilling a second identical core hole next to the sample core hole, chipping out the second core hole and then getting under the sample core with a lever and prying it out; 2) driving a pair of rods through the surrounding material and prying out the core; and 3) digging a wedge-shaped hole next to the core and prying it out. These methods are unsatisfactory, however, because the resulting sample core is often not intact. The methods are time consuming, and when the core sample is damaged, the process must be repeated. The problem of obtaining undamaged core samples has been a problem since the beginning of post-paving core testing.

SUMMARY OF THE INVENTION

It is an object of the present invention to provide an apparatus and method for obtaining test cores that are undamaged.

It is another object of the invention to provide an apparatus and method for obtaining test cores that are quick to use.

It is a further object of the invention to provide an apparatus and method for obtaining test cores which can be used with industry standard drill bits for taking core samples from pavement.

These and other objects and advantages of the present invention are realized in one embodiment by a core puller comprising a first split shell, including a first split portion; at least one handle attached to the first shell, and a first tightening device for moving confronting ends of the first shell towards each other, the first tightening device being located on an upper part of the first shell.

The method of the present invention includes the steps of providing a core puller, inserting the core puller into a space located around a core to be pulled, tightening the core puller around the core, and pulling the core.

BRIEF DESCRIPTION OF THE DRAWINGS

The present invention may be understood from the description of the preferred embodiments which follows and from the accompanying drawings. The drawings are hereby expressly made a part of the specification.

DETAILED DESCRIPTION OF THE PREFERRED EMBODIMENT

Figure 1:
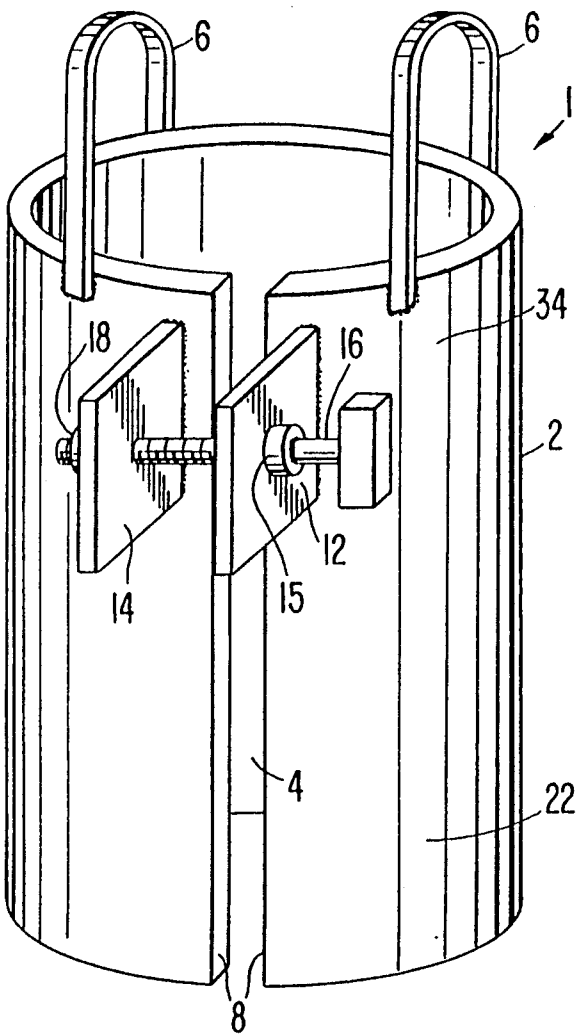
FIG. 1 is a perspective view of a first embodiment of the invention.

Referring first to FIG. 1, a first embodiment of the core puller 1 of the present invention includes a first split cylindrical shell 2 having a first split portion 4 and at least one handle 6. A tightening device for moving confronting ends 8 of the first shell 2 towards each other includes brackets 12, 14, clamping screw 16, and nut 18. The brackets 12, 14 are mounted on an upper part 34 of the shell 2 so that the lower part 22 of the shell is free from external obstructions, thereby allowing insertion of the lower part 22 into the cylindrical space created by the drill bit. All of the components of the core puller can be made of, for example, steel.

The diameter of the shell 2 can be varied according to the size of the drill bit used to drill out the core samples. One standard bit presently in use in the industry is approximately 6 inches in diameter; therefore, a diameter of the shell 2 can be approximately 6 inches.

The length of the unobstructed lower part 22 is varied according to the depth of the cores to be pulled. Generally, the length of the lower part 22 is varied from 2 to 6 inches, but other lengths are possible. The thickness of the shell 2 must be slightly less than the thickness of the standard drill bit. Steel plate of 3/32 inch thickness can be used to make the shell 2 as this 30 thickness will fit in the cylindrical space left by a standard drill bit. The handles 6 can be made from $\frac{3}{8}$ inch round stock and formed in a U-shape.

The brackets 12, 14 are provided with holes for receiving the clamping screw 16. The clamping screw and nut arrangement can be any of those known in the art whereby when the clamping screw 16 is rotated, the nut 18 advances on the clamping screw and the brackets 12, 14 are forced towards each other. The arrangement of FIG. 1–2 includes a positioning nut 15 welded to the clamping screw 16. Plate washers (not shown) are provided on both sides of the bracket 12. One washer is placed between the bracket 12 and the nut 15 and the second washer is placed on the opposite side of the bracket 12 and welded to the clamping screw 16. The nut 18 is welded to the bracket plate 14, and the clamping screw 16 is threaded through the nut 18. The clamping screw 16 may conveniently be provided with a T-shaped handle for ease of manual operation. As the clamping screw 16 is tightened, a force is applied to the brackets 12, 14 by way of the nuts 15, 18.

Because the brackets 12, 14 are rigidly mounted on the shell 2, the force is transmitted to the shell 2 so that confronting ends 8 of the shell are moved towards each other and the shell 2 grips the core sample to be pulled. As the shell 2 grips the core sample, the shell 2 undergoes elastic deformation. After the shell has been tightened around the core sample, the core puller and the intact core sample are pulled from the surrounding material using the handle 6. Thereafter, the clamping screw 16 can be loosened and the intact core sample removed from the core puller. As the clamping screw 16 is loosened, the shell 2 elastically returns to its relaxed condition.

Figure 3:
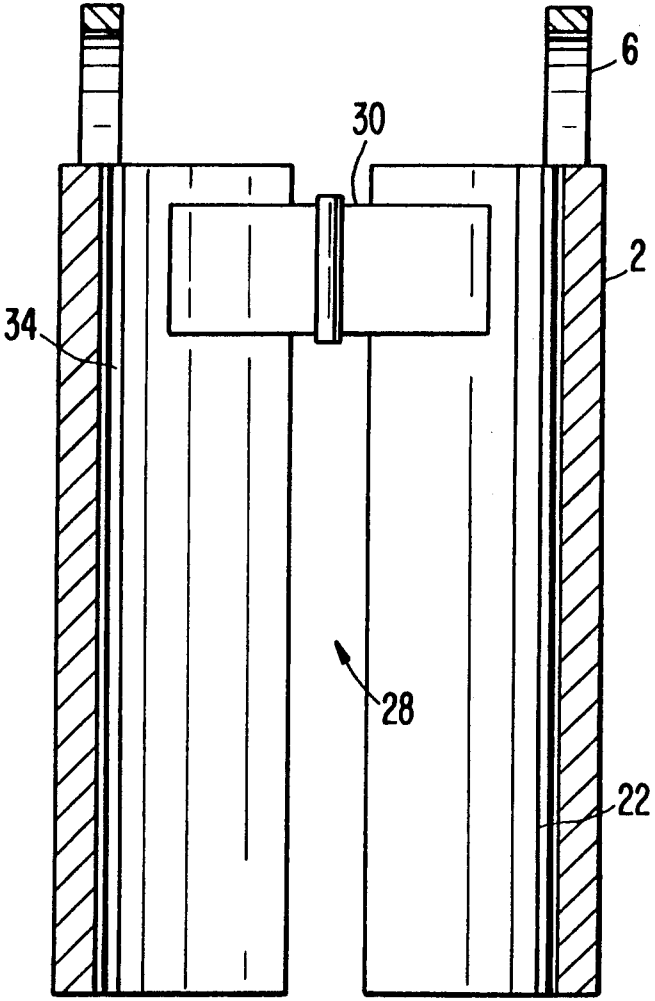
FIG. 3 is a cross-sectional view taken along the plane 3—3 of FIG. 5 and modified to include a hinge.
Figure 5:
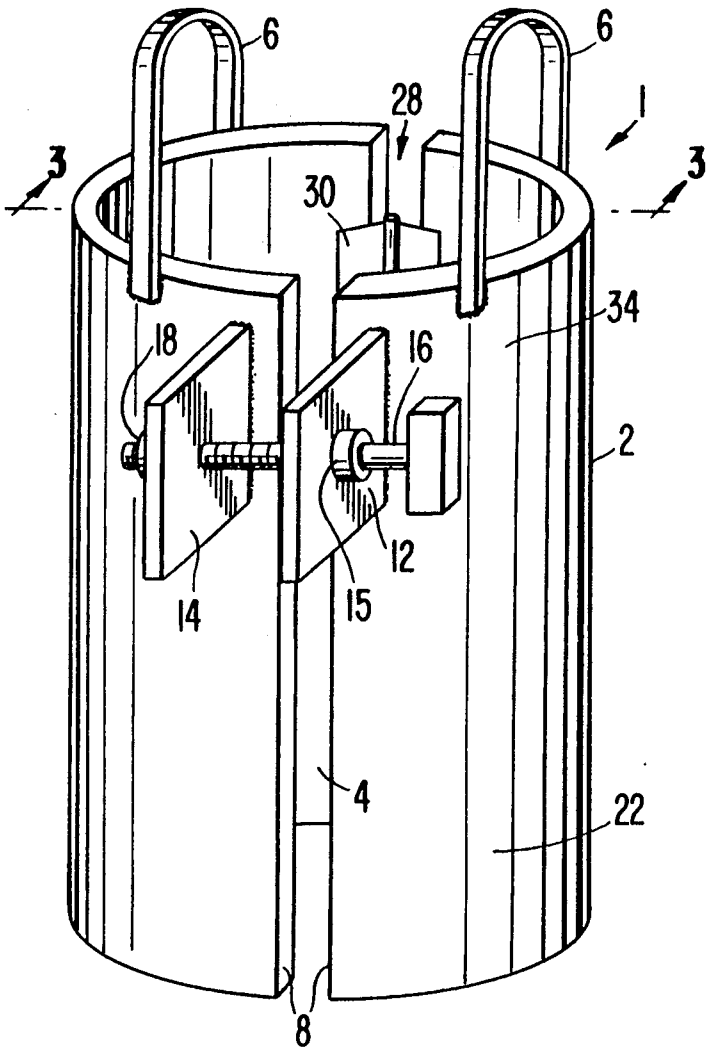
FIG. 5 is a perspective view of a modification of the first embodiment.

FIGS. 3 and 5 shows a modified version of the first embodiment of FIG. 1. The modification depicted in FIGS. 3 and 5 include a third split portion 28 located on the first shell 2 opposite the first split portion 4, and a hinge 30 located at the third split portion 28 and attached to an interior surface of the upper part 34 of the first shell. It is possible to locate the third split portion 28 at various positions on the first shell 2, rather than opposite the first split portion 4.

The operation of the embodiment modified to include the hinge as shown in FIGS. 3 and 5 differ from the operation of the first embodiment of FIG. 1 in that, with the hinge 30, it is not necessary to elastically deform the shell 2 in order to grip the core sample. Rather, the hinge 30 allows the shell to simply grip the core sample as the clamping screw 16 is tightened. Commercially available hinges can be used for the hinge 30.

As shown in FIGS. 3 and 5, the hinge 30 is mounted on the internal surface of the shell 2, but could also be mounted on the external surface of the shell 2. Whether mounted internally or externally on the shell 2, the hinge 30 should be mounted on the upper part 34 of the shell so that the lower part 22 remains unobstructed for insertion into the cylindrical space left by the drill bit.

Figure 2:
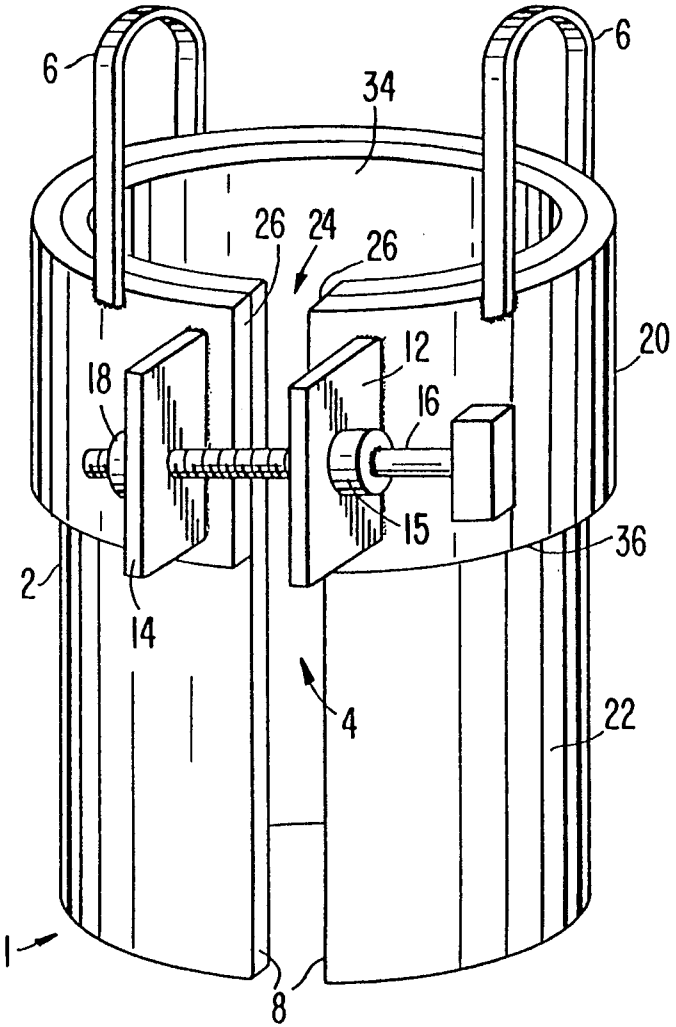
FIG. 2 is a perspective view of a second embodiment of the invention.

Referring now to FIG. 2, a second embodiment of the present invention is shown wherein the reference numerals used to describe the first embodiment represent similar components in the second embodiment.

The second embodiment further includes a second split cylindrical shell 20 attached to an outer surface of the upper part 34 of the first shell. The second shell 20 has a diameter greater than the diameter of the first shell. The second shell is fitted over and around the upper part of the first shell so that a lower part 22 of the first shell projects beyond a lower end 36 of the second shell. The second shell 20 has a second split portion 24 in substantial alignment with the first split portion 4. A tightening device for moving confronting ends 26 of the second shell towards each other includes brackets 12, 14, clamping screw 16 and nut 18. The operation of the clamping screw 16, nut 18, and brackets 12, 14 is similar to that of the first embodiment. The lower part 22 of the first shell 2 is made of a length which depends on the depth of the cores to be pulled. This length is conveniently made to be 2 to 6 inches.

The operation of the second embodiment according to FIG. 2 is similar to that of the first embodiment according to FIG. 1. The core puller is inserted into the cylindrical space left by the drill bit. The clamping screw 16 is then tightened thereby causing the first shell 2 to grip the core sample. The core sample and core puller are then pulled using the handles 6. The clamping screw 16 is loosened and the intact core sample is removed from the core puller.

In the embodiment of FIG. 2, both the first shell 2 and the second shell 20 elastically deform to tighten around the core sample. When the sample has been pulled and the clamping screw 16 loosened, the shells 2 and 20 elastically return to their relaxed position.

Figure 4:
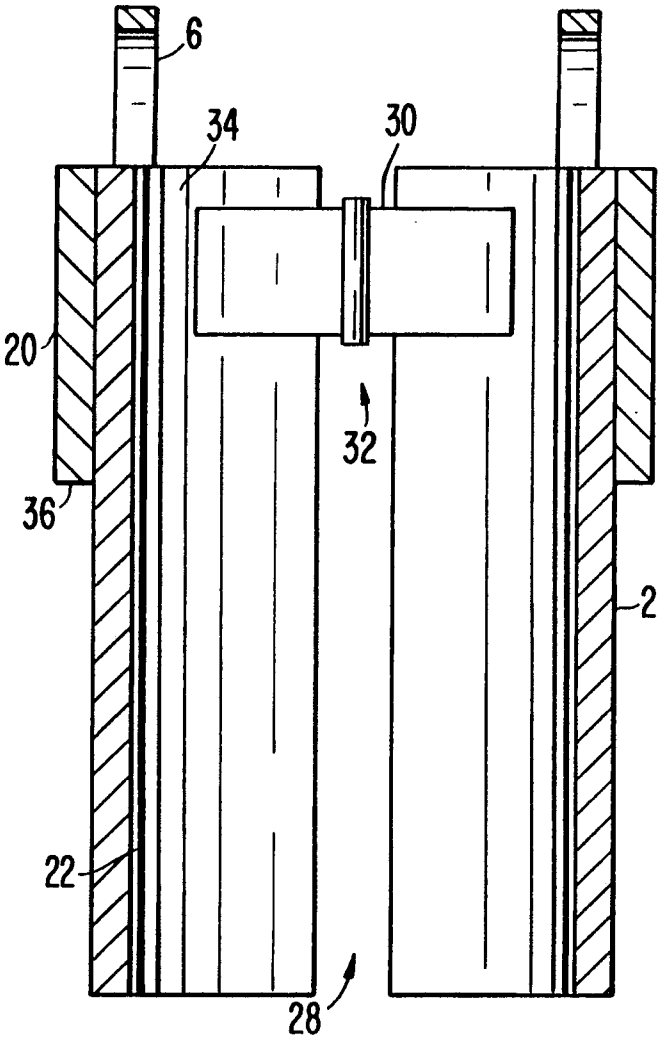
FIG. 4 is a cross-sectional view taken along the plane 4—4 of FIG. 6 and modified to include a hinge.
Figure 6:
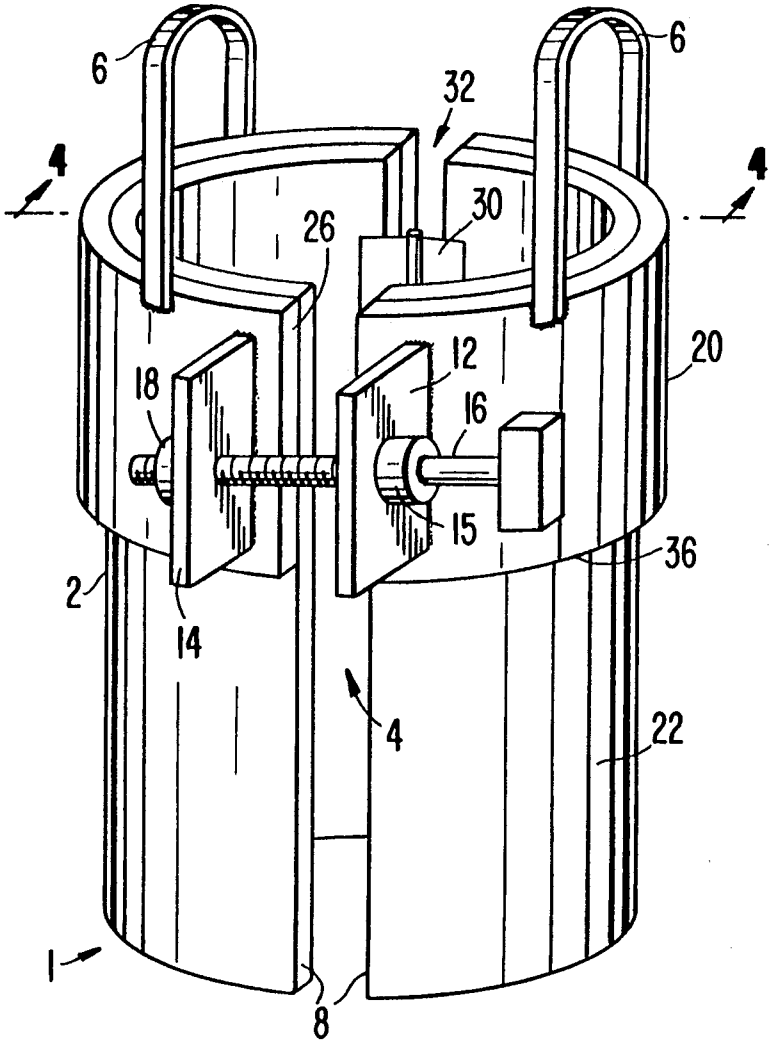
FIG. 6 is a perspective view of a modification of the second embodiment.

A modification of the second embodiment of FIG. 2 is shown in FIGS. 4 and 6. The modification of FIGS. 4 and 6 includes the addition of a third split portion 28 in the first shell 2, a fourth split portion 32 in the second shell 20, and a hinge 30. The third and fourth split portions 28, 32 are located opposite the first and second split portions 4, 24, respectively. It is also possible to locate the third and fourth split portions 28, 32 at various other positions on the first and second shells 2, 20.

A hinge 30 is located at either the third split portion 28 or the fourth split portion 32. If the hinge 30 is located at the third split portion 28, then the hinge 30 is attached to an upper part 34 of the first shell 2 on an interior surface thereof, as shown in FIG. 4. If the hinge 30 is located at the fourth portion 32, then the hinge 30 is attached to an upper part of the second shell 20 on an exterior surface thereof. In any event, the hinge 30 should be located far enough above the lower part 22 of the first shell 2 so as not to inhibit penetration of the shell 2 into the cylindrical space left by the drill bit.

The operation of the embodiment shown in FIGS. 4 and 6 is similar to that of the embodiment of FIG. 3. In the modifications of FIGS. 4 and 6, the shells 2 and 20 are not required to elastically deform in order to grip the core sample, because the hinge 30 allows the shells to move inward.

The use of the hinge 30 in the embodiments of FIGS. 3 and 4 allows less force to be used when tightening the clamping screw 16.

By way of example the first shell 2 is made of 3/32 inch plate rolled to 5 and 15/16 inch outside diameter. The second shell 20 is made of ⅛ inch plate rolled to 6 and ¼ inch outside diameter. The second shell is attached to the first shell by welding. The length of the second shell is 4 inches. The overall length of the first shell is from 6 to 10 inches. The clamping screw 16 and nuts 15, 18 are ½ inch in diameter. All materials used are commercially available and the fabrication techniques are conventional.

Although the drawings and description refer to the first and second shells 2, 20 as cylindrical, the invention is not limited to cylindrical shells. The shells may have any geometry which allows them to be fitted into the space left by a drill bit.

The embodiments of the present invention shown and discussed are by way of illustration and not of limitation, and a wide variety of equivalent embodiments may be made without departing from the spirit or scope of the invention.

What is claimed is:

1. A core puller for pulling a core surrounded by a space, comprising:

a first split shell including a first split portion and confronting ends;

at least one handle attached to the first shell; and a tightening device for moving the confronting ends of the first shell towards each other, the tightening device being located on an upper part of the first shell, the tightening device comprising:

two brackets attached to the upper part of the first shell, one bracket on each side of the first split portion, each bracket having a hole formed therein; and a clamping screw and a nut, the clamping screw being fitted through the holes in the brackets, the nut being threaded on one end of the clamping screw, whereby the confronting ends of the first shell are moved towards each other by advancing the nut on the clamping screw;

wherein a lower part of the first shell is free from external obstructions thereby allowing insertion of the lower part into the space.

2. The core puller of claim 1 further comprising:

a second split portion located on the first shell; and a hinge located at the second split portion and attached to the upper part of the first shell.

3. A core puller for pulling a core surrounded by a space, comprising:

a first split shell including a first split portion and confronting ends;

at least one handle attached to the first shell; and a tightening device for moving the confronting ends of the first shell towards each other, the tightening device being located on an upper part of the first shell, the tightening device comprising:

a second split shell attached to an outer surface of the upper part of the first shell, the second shell having a diameter greater than a diameter of the first shell, the second shell being fitted over the upper part of the first shell, the lower part of the first shell projecting beyond a lower end of the second shell, the second shell having a second split portion in substantial longitudinal alignment with the first split portion and having confronting ends;

two brackets attached to an upper part of the second shell, one bracket on each side of the second split portion, each bracket having a hole formed therein; and a clamping screw and a nut, the clamping screw being fitted through the holes in the brackets, the nut being threaded on one end of the clamping screw, whereby the confronting ends of the second shell are moved towards each other by advancing the nut on the clamping screw thereby causing the confronting ends of the first shell to move towards each other;

wherein a lower part of the first shell is free from external obstructions thereby allowing insertion of the lower part into the space.

4. The core puller of claim 3 further comprising:

third and fourth split portions located on the first and second shells, respectively; and a hinge located at one of the third and fourth split portions, and attached to one of the upper part of the first shell and an upper part of the second shell, respectively.

5. The core puller of claim 3 further comprising a second handle, the handles being located on opposite sides of an upper part of the second shell, the handles being U-shaped.

6. The core puller of claim 3, wherein a length of the lower part of the first shell projecting beyond the lower end of the second shell is from 2–6 inches.

7. The core puller of claim 3 wherein a diameter of the first shell is approximately 6 inches.

* * * * *

UNITED STATES PATENT AND TRADEMARK OFFICE

CERTIFICATE OF CORRECTION

PATENT NO. : 5,328,221

DATED : July 12, 1994

INVENTOR(S) : Thomas Daniel RICHARDSON, Jr.

It is certified that error appears in the above-indentified patent and that said Letters Patent is hereby corrected as shown below:

Column 2, line 8, "and modified to include a hinge; and" should be deleted.

Column 2, line 10, "and modified to include a hinge" should be deleted.

Column 2, line 10, a "semi-colon" should be included after --6--.

Column 2, line 41, delete "30".

Column 3, line 3, "shows" should read --show--.

Column 3, line 10, "include" should read --includes--.

Column 3, line 18, "differ" should read --differs--.

Signed and Sealed this

Twenty-first Day of March, 1995

*Attest:*

Bruce Lehman

BRUCE LEHMAN

*Attesting Officer*

*Commissioner of Patents and Trademarks*